US005660533A

United States Patent [19]

Cartwright

[11] Patent Number: 5,660,533

[45] Date of Patent: Aug. 26, 1997

[54] VACUUM ASSISTED PRIMING AND COOLING SYSTEM FOR A PUMP

[75] Inventor: John K. Cartwright, Newark, Ohio

[73] Assignee: The Gorman-Rupp Company, Mansfield, Ohio

[21] Appl. No.: 556,106

[22] Filed: Nov. 9, 1995

[51] Int. Cl.[6] ..... F04B 39/00; F04B 53/00

[52] U.S. Cl. ..... 417/435; 137/202

[58] Field of Search ..... 417/435, 440; 137/202; 251/901

[56] References Cited

U.S. PATENT DOCUMENTS

| | | | |
|---|---|---|---|
| 3,296,973 | 1/1967 | Paish et al. . | |
| 3,307,492 | 3/1967 | Selwood et al. . | |
| 3,591,316 | 7/1971 | Piccirilli | 417/435 |
| 3,726,303 | 4/1973 | Allen et al. . | |
| 3,904,319 | 9/1975 | Paish et al. . | |
| 4,381,928 | 5/1983 | Roffelsen | 137/202 |
| 5,020,567 | 6/1991 | Proulx | 251/901 |

OTHER PUBLICATIONS

Article Authored by A. Tynan, Entitled "Pump Priming by Applied Vacuum", pp. 167–169, World Pumps, Date Unknown.

Article Authored by C.E.J. Sheather, Entitled "Design Improvements to a Solids Handling Auto Priming, Torque Flow Pumps", pp. 143–147, Date Unknown.

*Primary Examiner*—Charles G. Freay

*Attorney, Agent, or Firm*—Watts, Hoffmann Fisher & Heinke

[57] ABSTRACT

A vacuum assisted pump priming system which includes a vacuum chamber communicating with a pump inlet via a transfer passage. A valve assembly within the vacuum chamber controls the communication of a vacuum source with the chamber. The valve assembly includes a semi-cylindrical valve body having a plurality of ports by which the vacuum source is communicated with the vacuum chamber. A closure element, attached to a float, is operative to block the vacuum ports when the float rises above a predetermined level in the vacuum chamber in response to liquid entering the chamber. A lost motion connection is established between the float and the valve body, which enables the float to rise above the predetermined level, while the closure element maintains its blocking relationship with the ports. The float includes an enlarge portion that acts as a defuser and a tamper portion which is received in the transfer passage and is operative to dislodge matter drawn into the transfer passage. The float may include extension portions which act as shields and occupy additional volume in the vacuum chamber in order to reduce the liquid level rise in the chamber. The valve body and closure element may be arranged at a predetermined angle to promote drainage and a shield overlies the transfer passage to inhibit the entry of solids into the vacuum chamber. A two-stage eductor assembly is used to provide cooling for a seal chamber forming part of the pump.

35 Claims, 7 Drawing Sheets

VACUUM ASSISTED PRIMING AND COOLING SYSTEM FOR A PUMP

TECHNICAL FIELD

The present invention relates generally to pumps and, in particular, to pumps which use a vacuum source to aid or effect priming of the pump at start-up or to maintain the prime of the pump during its operation.

BACKGROUND ART

For at least some pumping applications which employ centrifugal pumps, a vacuum source connected at or near the inlet of the pump is used to aid or effect priming of the pump at start-up or to maintain the priming of the pump during its operation. One application Of this type of centrifugal pump is in the pumping of sewage.

There are several methods for creating a source of vacuum for the centrifugal pump. One method utilizes an "eductor" which those skilled in the art will recognize as a device which uses high pressure air flowing through a venturi to create a source of vacuum. Another method of providing the required vacuum is the use of a vacuum pump. To effect priming of a pump, the vacuum source is placed in fluid communication with the pump inlet in order to remove air or other gases from the pump inlet. As the air/gas is removed, liquid is drawn into the inlet to replace the air/gas removed by the vacuum source; the centrifugal pump is then able to commence pumping of the liquid.

It should be apparent that it is undesirable for the pumpage to enter the vacuum system (often termed "carry over"). When a vacuum pump is used as a source of vacuum, it is easily damaged if the liquid being pumped, even if water, enters the pump.

Eductor-type systems are generally less sensitive to the ingestion of carry-over and may include apparatus for discharging carry-over drawn into the vacuum systems. If the carry-over is other than water, its discharge from the vacuum system may have to be carefully controlled. This is especially true of pumps used in sewage applications.

Efforts have been made to control the entry of liquid into the vacuum system. Many pumps of this type incorporate a float valve which closes off the vacuum passage when liquid in the priming chamber rises to a predetermined level. One suggested solution involves the use of peel valve which covers a flat plate containing ports communicating with the vacuum source, when the level in the priming chamber rises to a certain level.

It is believed that these prior efforts have not been entirely satisfactory. In actual operation, it has been found that surges occur in the fluid being pumped which cause abrupt changes in liquid level in the priming chamber. It is believed that the surging fluid can cause unseating of the vacuum valve and allow fluid from the priming chamber to enter the vacuum system. In some prior art pumps, provisions have been made for dealing with carry-over into the vacuum system by providing additional separating devices for recapturing the fluid entering the vacuum system and returning it to the pump. This adds unwanted expense to the pumping systems.

Vacuum assisted priming systems for pumps, by their design, allow pumps to lose prime due to lack of pumpage and then effect repriming of the pump when pumpage again becomes available. This periodic loss of prime is often encountered when pumps are used for drainage and like operations. Because of this repriming capability, pumps may run "dry" for extended periods of time. Most of these pumps have mechanical seals for inhibiting the leakage of pumpage out of the pumping chamber. These mechanical seals are subject to failure if they are allowed to overheat, which may occur when the pump is run dry. Attempts at solving this seal problem have been made in the past. One suggested solution is to use carbide facings for the seal and to immerse the external side of the seal in an oil bath. Some manufacturers have even gone to the step of creating circulation of the seal oil by using an elevated oil header tank operating on a thermo-syphon system that uses the density changes within the oil to generate a flow from hot to cool. These methods for cooling the seal have not been totally satisfactory.

DISCLOSURE OF INVENTION

The present invention provides a new and improved vacuum assisted priming system which utilizes a float operated valve assembly for controlling the communication of a source of vacuum with the inlet side of a fluid pump, such as a centrifugal pump.

To facilitate the explanation, the present invention will be described in connection with a centrifugal pump, but it should be understood that the principles of this invention are equally applicable to other types of fluid pumps, such as positive displacement pumps and the present invention should not be limited to a centrifugal pump.

According to the invention, the vacuum assisted priming system includes structure defining a vacuum chamber that is connectable to a source of vacuum. A valve assembly controls the communication of the source of vacuum with the vacuum chamber and includes a valve body located within the chamber having at least one port for communicating the source of vacuum with the chamber. A closure element is engageable with the valve body in a blocking relationship with respect to the port, whereby the communication of the vacuum source with the chamber is terminated. A float located within the chamber is operatively connected to the closure element and is operative to move the closure element into blocking engagement with the port defined in the valve body when the float rises above a predetermined level. A lost motion connection is provided between the float and the closure member which enables the float to rise to a level above the predetermined level while the closure element maintains its blocking engagement with the port.

According to the preferred and illustrated embodiment, the valve body defines a plurality of ports which are all blocked by the closure element when the float rises to the predetermined level. According to the preferred embodiment of the invention, the closure element is defined, at least in part, by a sheet-like member, a portion of which is attached to the valve body and another portion of which is attached to the float. the lost motion connection is defined by a section of the sheet member which permits relative movement between a closure portion of the sheet member and the float, thereby allowing the float to rise to a level above the predetermined level while the ports defined by the valve body continue to be blocked by the sheet member.

According to a feature of the invention, the float includes an enlarged portion which acts as a defuser for liquid entering the vacuum chamber. With this feature, surges which cause sudden fluctuations in liquid level in the vacuum chamber do not result in liquid being splashed into the ports of the valve body. The shape of the float eliminates the need for a separate defuser member.

According to another feature of the invention, the float includes a tamper portion which preferably depends downwardly from the enlarged portion. In the preferred embodiment, the tamper portion is sized to fit a transfer passage which communicates the vacuum chamber with a pump inlet. In a more preferred embodiment, both the enlarged portion and tamper portion of the float are substantially square in cross-section. In the preferred construction, the float has relatively low buoyancy, so that as the liquid level falls in the vacuum chamber, the float responds quickly and with sufficient force that the tamper portion located within the fluid passage is able to dislodge matter (carried by the pumpage) that may have been drawn into the transfer passage.

According to the preferred embodiment, the buoyancy of the float may be adjusted by selecting or adjusting the weight of a bracket used to connect the closure member with the float. Alternately, material selection for the float may be used or the float itself may be filled with material to adjust its buoyancy.

In the preferred and illustrated embodiment, a check valve is located intermediate the vacuum source and the valve body and serves to maintain a vacuum in the chamber should the vacuum source become inoperative or disconnected.

According to another preferred embodiment of the float, the float includes two extensions, which preferably extend upwardly from the enlarged portion. The extensions operate to take up additional volume within the vacuum chamber and act to reduce the rise in the level of liquid in the vacuum chamber when the vacuum valve closes. The extensions may also act as shields to inhibit liquid from splashing onto the valve seat and/or closure member. The extensions may also serve as an additional means for adjusting the buoyancy of the float.

In another disclosed embodiment, the valve assembly is arranged at a predetermined angle β, with respect to the horizontal. In this embodiment, liquid and/or liquid carried solids splashed onto the closure member, or valve body, drain from the valve assembly. The angled orientation of the closure element and associated components tends to cause cleansing of these components to prevent the accumulation of solids that would otherwise interfere with the sealing between the closure member and the valve body. In the illustrated embodiment, the angle β is approximately 25°. It is believed that an angle in the range or 15°–45° would provide satisfactory results and is contemplated by the present invention.

According to another feature of the invention, a shield which may be in the form of a movable flapper is disposed within the inlet passage. During pump operation the shield prevents direct or "line-of-sight" communication between the pump passage and the transfer passage, thus reducing the likelihood of solids entering the vacuum chamber. In the preferred and illustrated embodiment, the shield includes a kicker portion which defines an expanding passage which opens into the inlet passage. A venturi-like effect is created by the main flow of pumpage through the conduit which tends to extract liquid from the vacuum chamber, thus reducing the liquid level within the vacuum chamber.

In the illustrated embodiments, the priming system forms part of a separate assembly or unit that is attached to an inlet of a pump. In particular, the assembly includes a flange by which the unit is attached to the inlet of the pump. A flow passage defined by the unit communicates with the inlet to the pump. In the illustrated construction, the unit includes a second flange by which an inlet pipe is connected to the unit and which is thus communicated with the pump inlet via the flow passage in the unit. The unit includes a separate vacuum chamber which communicates with the flow passage defined by the unit via a transfer passage. It should be understood, however, that the invention may be integrated directly with a pump and not be a separate component.

According to another feature of the invention, an arrangement is provided for cooling a pump seal. In the preferred and illustrated embodiment, a cascaded eductor system is employed to provide a flow of air through a seal chamber by which heat generated within the chamber is removed. The eductor system includes a first or primary eductor connected to a source of compressed air which is used to create the vacuum for the vacuum chamber. A downstream or secondary eductor utilizes the air discharged by the first eductor to generate a region of low pressure at an outlet of a conduit, which extends through the seal chamber. Air is drawn through an inlet to the conduit and travels to the low pressure outlet. As it travels along the conduit, it carries away heat transferred to the walls of the conduit by the liquid in the seal chamber.

The secondary eductor does not require a separate source of energy, nor does it add to the energy load of the source of compressed air. It merely uses air discharged by the primary eductor and, consequently, does not increase the energy requirement for operating the pump.

Additional feature of the invention and a fuller understanding will be obtained by reading the following detailed description made in connection with the accompanying drawings.

BEST MODE FOR CARRYING OUT THE INVENTION

Figure 1:
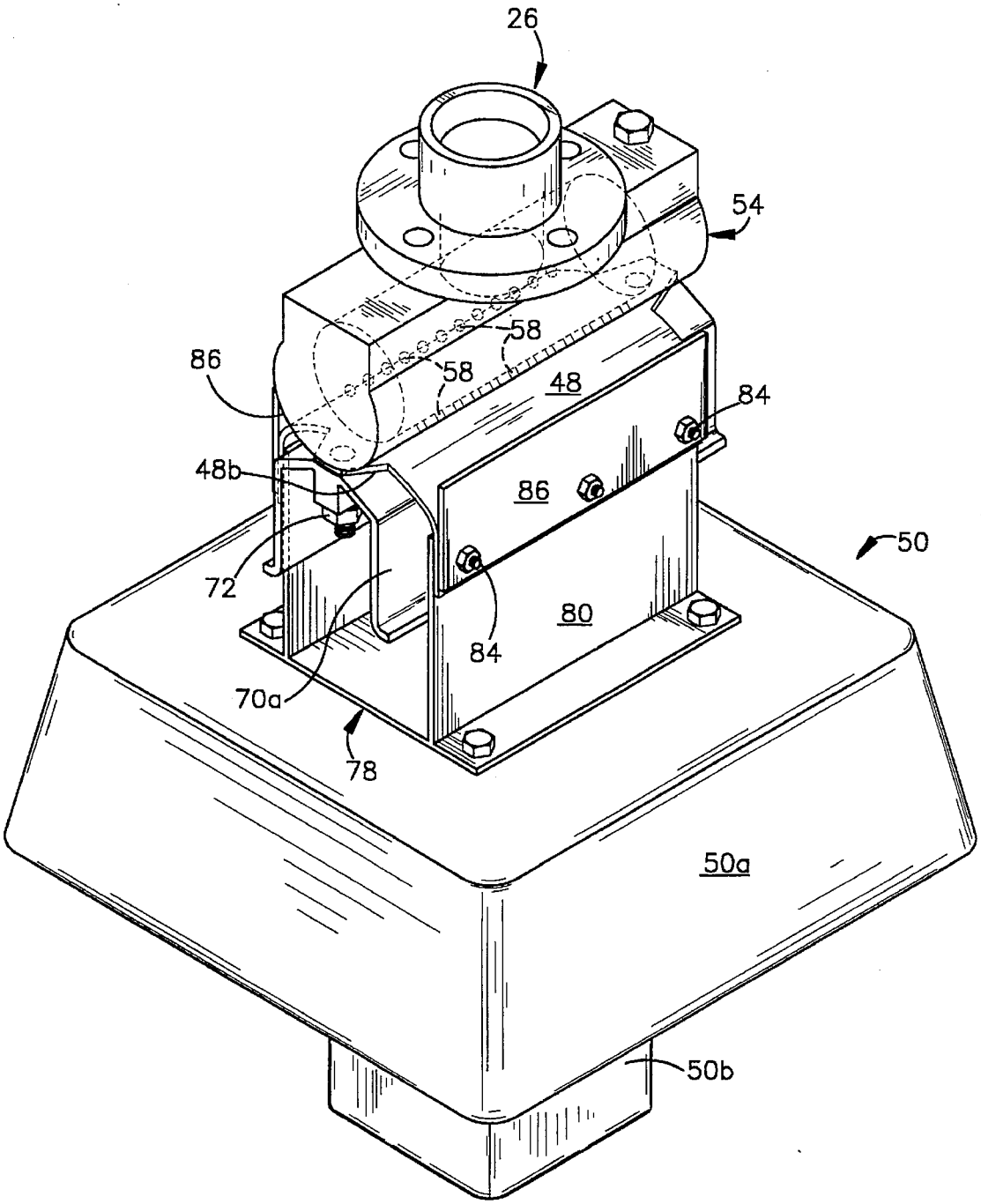
FIG. 1 is a fragmentary, sectional view of a vacuum assisted priming assembly constructed in accordance with a preferred embodiment of the invention.
Figure 2:
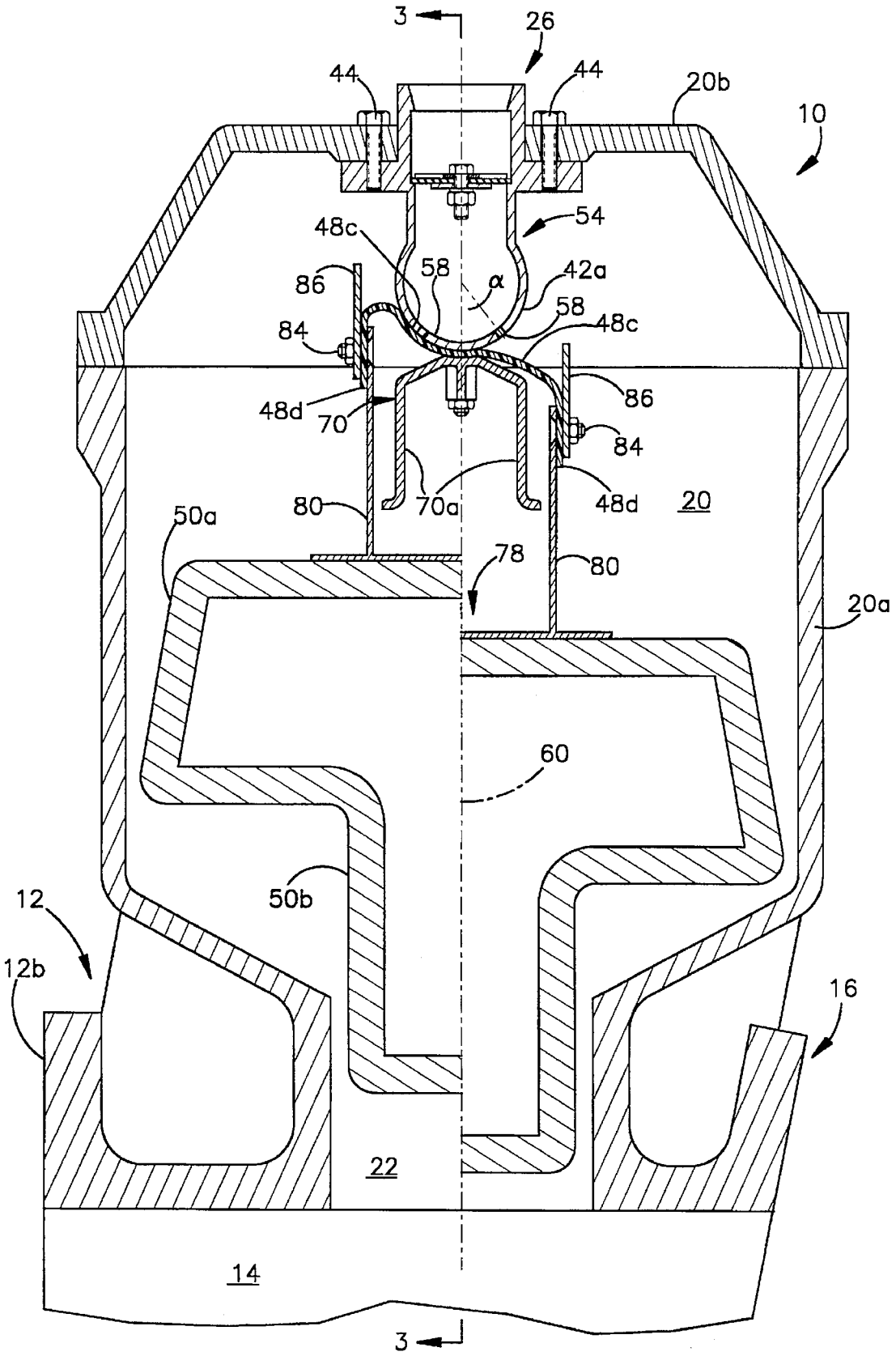
FIG. 2 is another fragmentary, sectional view of the vacuum assisted priming assembly, showing a vacuum valve in two different positions.

FIGS. 1 and 2 show the overall construction of a vacuum assisted priming assembly 10 embodying the present invention. The priming assembly 10 in the preferred embodiment is a self contained unit that is attachable to the suction inlet of a pump, such as a centrifugal sewage pump (not shown). The assembly 10 includes a circular flange 12 defining a plurality of mounting holes **12*a* and a planar mounting surface 12*b* (shown in FIG. 2). The flange 12** is bolted to a mating flange of the pump (not shown) which typically forms part of the pump inlet. Other mounting arrangements, however, are contemplated by the present invention and accordingly, this invention should not be limited to one in which mating flanges are used to mount the apparatus.

The priming assembly 10 defines a circular passage 14 through which pumpage travels on its way to the pump inlet. Once mounted to the pump, the passage 14, in effect, forms part of the pump inlet.

As seen in FIG. 2, the assembly includes another mounting flange 16 by which an inlet pipe or conduit (not shown) is attached to the priming assembly 10.

The priming assembly includes a vacuum chamber 20 which communicates with the pumpage flow passage 14 via a suction hole or transfer passage 22. The chamber 20 is defined by an integrally formed hopper 20*a* to which a cover 20*b* is sealingly attached. A fitting indicated generally by the reference character 26 is provided by which a connection to a vacuum source 28 (shown schematically) is made. In the illustrated embodiment, the fitting 26 includes a flapper-type check valve 30. The check valve 30 allows the flow of air/gas from the vacuum chamber 20 to the vacuum source 28, but prevents reverse flow. In operation, the check valve 30 seals the vacuum chamber 20 should the vacuum source become inoperative or disconnected from the fitting 26. Under these conditions, the check valve 30 will maintain a vacuum in the vacuum chamber 20.

As indicated above, in the preferred and illustrated embodiment the priming assembly forms a separate component which is attached to the pump inlet. It should be understood that in an alternate embodiment, the priming system may form an integral part of the pump, i.e., the vacuum chamber 20 may be integrally formed with the pump inlet and may not be a separately attached item. The invention should, thus, not be limited to a vacuum assisted priming system that is formed by a component separate from actual pump.

The communication of the vacuum source 28 with the chamber 20 is controlled by a vacuum valve indicated generally by the reference character 40 which, for purposes of explanation, will be referred to as a peeler-type valve. The vacuum valve includes a fixed portion 42 which is secured to the cover 20*b* by a plurality of fasteners 44.

A movable portion 46 includes a float operated closure member 48 (see FIG. 2), which also provides a lost motion connection between the fixed and movable portions 42, 46 of the vacuum valve 40. The movable portion is formed by a float 50 and the closure member 48. The float moves vertically towards and away from the fixed portion 42 in response to pumpage entering the vacuum chamber 20.

Referring in particular to FIG. 2, the fixed portion 42 of the valve defines a valve seat 54 which is wrappingly engageable by the closure member 48. In the preferred and illustrated embodiment, the seat, 54 is defined by an elongate, semi-cylindrical body 42*a*, which defines a plurality of ports 58, on either side of a imaginary central plane indicated by the line 60. In the preferred embodiment, the axes of the ports 58 define an angle $\alpha$ of approximately 30° with respect to the centerline 60. The ports are preferably arranged in two lines on either side of the centerline or plane 60.

Figure 3:
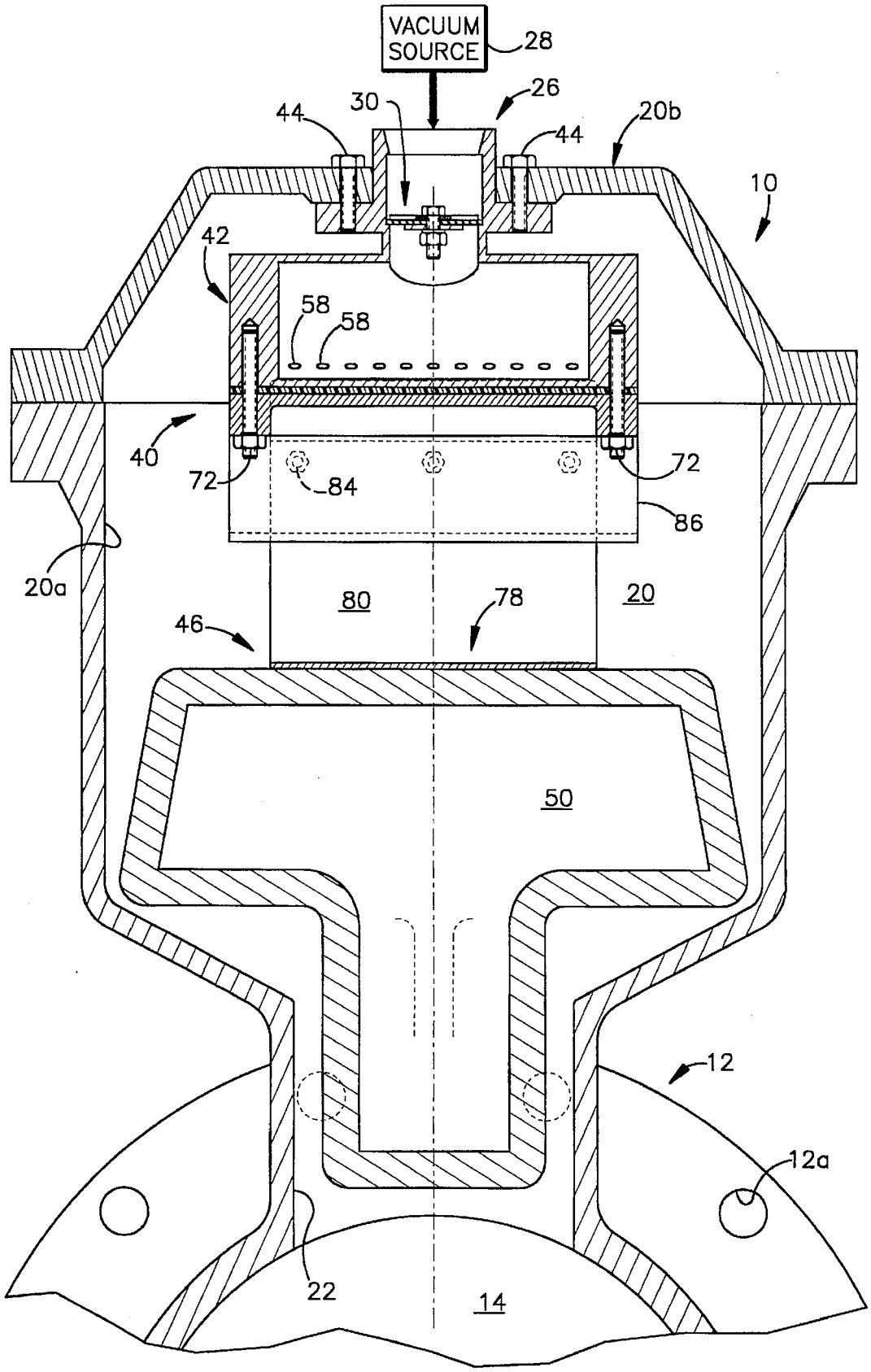
FIG. 3 is a perspective view of the vacuum valve forming part of the vacuum assisted priming assembly shown in FIG. 1.

Referring also to FIGS. 1 and 3, the closure member 48 is a sheet-like, strap member and is preferably formed from a flexible sheet material, such as reinforced rubber. A center portion of the closure member indicated generally by the reference character 48*b* (see FIG. 3) is clamped to the valve seat 42 at or near the imaginary center plane 60. In particular, the closure member 48 is clamped between the seat 54 and a U-shaped clamp plate 70 by a pair of stud-type fasteners 72. The clamp plate 70 includes a pair of parallel, depending legs 70*a*, which are bent outwardly at their lower ends.

The illustrated construction which utilizes a sheet-like closure member 48 allows relative vertical movement between the float 50 and the valve seat 54 while substantially resisting relative transverse or side-to-side movement.

As indicated above, the closure member 48 is moved into a wrapping-like engagement with the contoured or cylindrical surface of the valve seat 54 as the float 50 rises. In particular, sealing sections 48*c* are defined on either side of the center portion 48*b* which are engageable with the respective lines of ports 58. As seen best in FIGS. 2 and 3, the float 50 mounts a bracket 78 having a pair of upstanding, parallel legs 80. Opposite sides, i.e, peripheral ends or edges 48*d*, of the strap-like member 48 are fastened to the upper ends of the legs 80 by a plurality of fasteners 84. In addition, a pair of guide plates 86 are also mounted to the bracket utilizing the same fasteners 84. The guide plates help control the movement of the closure member 48 as the float 50 rises and ensures that the closure member moves into a wrapping engagement With the valve seat 54, as opposed to simply bending or billowing outwardly beyond the planes of the bracket legs 80. In addition, the guide plates 86 help protect the valve seat area from fluid or pumpage splashing in the vacuum chamber, so that the chances of pumpage entering the vacuum system is reduced.

Referring to FIG. 3, the float is mushroom-shaped in cross-section (see FIG. 2), but is preferably rectangularly-shaped. The float 50 includes an enlarged head portion 50*a* and a depending tamper portion 50*b*. The tamper portion 50*b* loosely fits within the transfer passage 22 which preferably is also square in cross-section. Sufficient clearance is provided between the tamper portion 50*b* and the walls defining the passage 22, so that air and other gases in the pumpage can easily enter the vacuum chamber 20.

In the preferred embodiment, the float is constructed to have a relatively low buoyancy so that when the fluid level within the vacuum chamber 20 drops, the float 50 moves downward quickly and with a force sufficient to dislodge solids that may have been drawn into the transfer passage 22.

In the preferred embodiment, the float 50 is a molded, hollow plastic part. Its buoyancy is adjusted by various means. In the preferred embodiment, the weight of the bracket 78 (which may be made from a relatively heavy material such as brass) is used, at least in part, to determine the buoyancy of the float member 50. Other well known methods may be used to adjust its buoyancy, such as separate weights or a fill material within the float member itself.

In an alternate embodiment, the tamper portion 50*b* of the float 50 may be fitted with blades, brushes, or other elements which are used to scrape the walls of the passage 22 in order to remove solids or other material that may be drawn into and accumulate in the passage 22.

The priming system operates as follows. At pump start-up, or at any time the pump has lost prime, the passage 14 is partly or totally devoid of liquid. As a result, the float 50 moves downwardly to the position illustrated in the right half of FIG. 2. In this position, the ports 58 are uncovered by the closure member 48 and, as a result, the vacuum source is communicated to the inside of the vacuum chamber 22. The vacuum source is then effective to draw out any air or gas in the vacuum chamber 20 and the flow passage 14 via the transfer passage 22. As the air/gas is removed, the passage 14 fills with pumpage and the pump itself begins pumping now that it is primed.

As the vacuum source 28 continues to draw air/gas from the inlet, pumpage then enters the vacuum chamber 20 via the passage 22. As it enters the passage, the float rises. When it rises to a predetermined level, the ports 58 are covered by the closure member 48 and, hence, the vacuum source 28 is isolated from the vacuum chamber 20 and no more air/gas is drawn from the inlet. However, depending on the dynamics of the pumping operation, surges of pumpage into the vacuum chamber 20 may occur which cause the float 50 to rise to even a higher level. Because of the wrapping engagement provided by the closure member 48, this additional vertical movement is allowed. In effect, a lost motion connection is provided. This additional vertical movement in the float 50 is permitted without affecting the closure of the ports 58. As a result, significant vertical oscillations in the float member 50 in response to surges in pumpage are accommodated without risk of prematurely uncovering the vacuum ports 58 which would result in the ingestion of pumpage by the vacuum system. The design of the float 50 which incorporates a tamper 50*b* to create a self-cleaning action in the transfer passage 22 eliminates the need for screens or other apparatus to restrict the entry of solids into the vacuum chamber 20.

The low buoyancy float promotes quick opening of the vacuum valve 40 as liquid exits the vacuum chamber 20 and also provides a stabilizing mass to prevent jiggling of the float during surge conditions. In effect, the relatively heavy float provides both potential and kinetic energy to the tamper 50*b* situated under the main float portion 50*b*. In addition, the large external contour of the upper part 50*a* of the float 50 provides a defusing effect to the upward passage of liquid during surge conditions within the vacuum chamber 20.

The construction of the sheet-like strap member 48 provides flexibility in the plane designated to closing the vacuum ports 58 in the valve seat 54 while providing effective restraint in other planes in order to control float oscillations or lateral movement. In short, the design and geometry of the vacuum valve 40 is such that only a small liquid level rise in the vacuum chamber shuts off vacuum source while still allowing substantial additional vertical movement in the float 50 as additional liquid enters the vacuum chamber 20. As the float 50 rises above the predetermined closure level, the hoop sealing forces by which the closure member 48 engages the valve seat 54 increases again reducing the risk of liquid entering the vacuum source.

As an example, in a prototype pump built according to the principles of this invention, a three quarter inch liquid level rise in the vacuum chamber 20 produced closure of the vacuum ports 58, thus, isolating the vacuum source from the vacuum chamber 20. The vacuum valve 40 in this prototype pump, however, permitted the float 50 to rise an additional two inches or more. Even in conditions where the liquid level could drop suddenly, the vacuum valve 40 remained closed until the float 50 dropped more than two inches.

Figure 4:
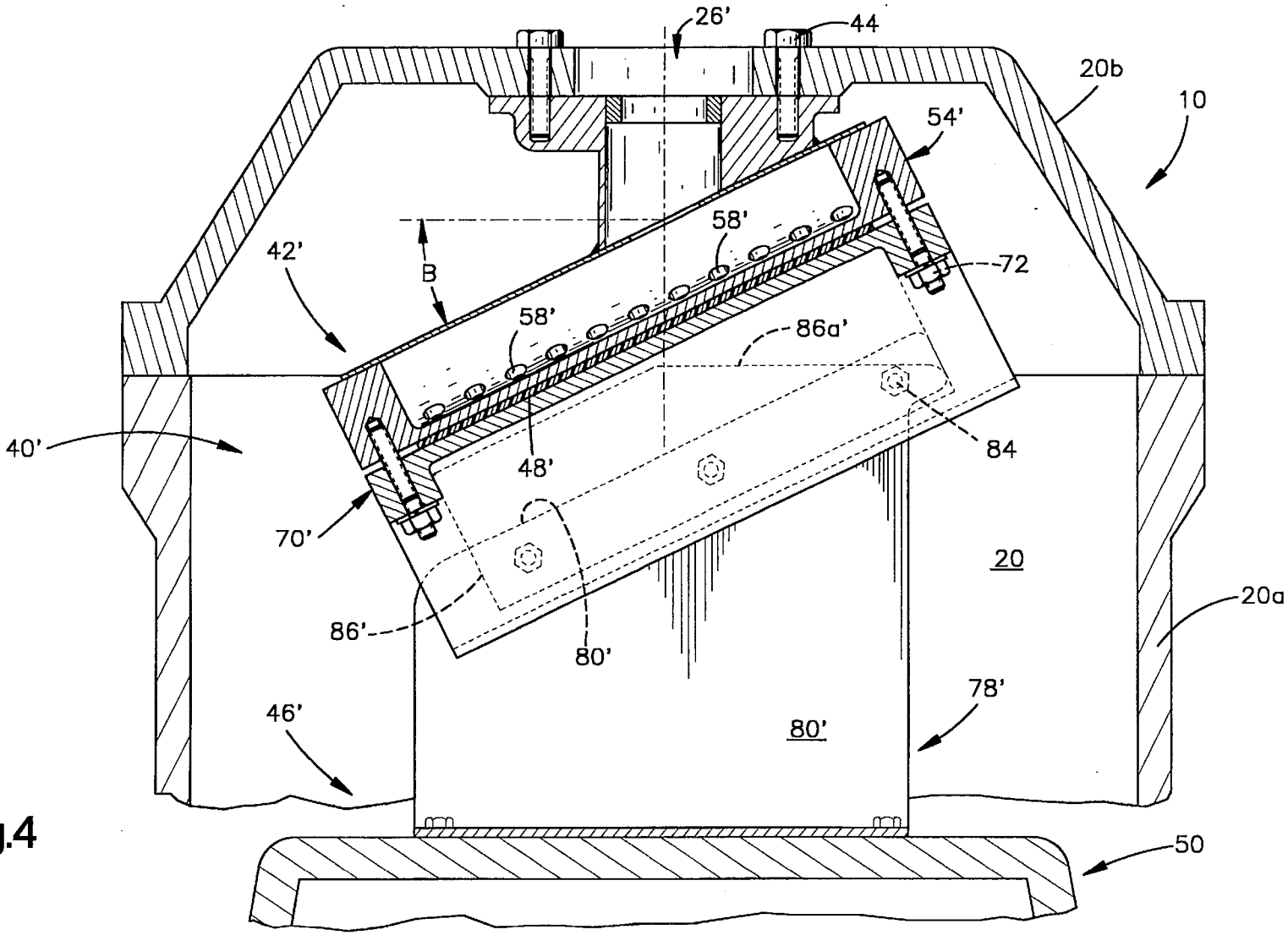
FIG. 4 is a fragmentary, sectional view of a priming assembly constructed in accordance with an alternate embodiment of the invention.

FIG. 4 illustrates an alternate embodiment of a vacuum valve 40'. For purposes of explanation, components in the alternate embodiment that are identical to components used in the FIG. 1 embodiment, will be given the same reference character; similar or modified components in the alternate embodiment will be given the. same reference character followed by an apostrophe.

The vacuum valve 40' of the alternate embodiment includes fixed and movable portions 42', 46'. As in the first embodiment, the movable portion 46' includes a float operated closure member 48'. The primary difference between the FIG. 1 and FIG. 4 embodiments is that the valve body 54' and closure member 48' are arranged at an angle β with respect to the horizontal. By arranging the components at the angle β, drainage of splashed liquid, including solids, is promoted. The draining of liquid that splashes onto the closure member 48' tends to wash or cleanse the upper surface of the closure member 48'. As liquid drains from the upper surface, it tends to carry away any solids that may have been splashed onto the closure member which, if not removed, could compromise sealing of the closure member 48' against the valve body 54'. In the illustrated embodiment the angle β is approximately 25°, but a range of 15°–45° is contemplated.

As seen in FIG. 4, the valve body 54' defines a plurality of ports 58' by which the chamber 20 communicates with a vacuum source connected to the valve body. The valve body 54' is attached to the roof 20*b* of the vacuum chamber by bolts 44 and is connected to a vacuum source via fitting 26'.

The closure member 48' is clamped to the valve body by a U-shaped clamp member 70', by the stud-type fasteners 72.

The movable portion of the vacuum valve assembly 46' includes a bracket 78' attached to the float 50 and includes a pair of upstanding legs 80'. As seen clearly in FIG. 4, an upper edge 80*a*' of the bracket leg 80' also defines an angle with respect to the horizonal. The angle preferably corresponds to the angle β defined by the valve body with respect to the horizontal. The movable portion 46' also includes guide plates 86' which help control the movement of the closure member 48' as the float 50 rises. The guide plate 86' includes a horizontal edge segment 86*a*' which permits the movable portion 46' of the vacuum valve assembly to rise to its maximum height (determined by the closure member 48'). If the guide 86' were rectangular as in the FIG. 1 embodiment, an upper corner of the guide plate would strike the roof of the vacuum chamber prior to full closure of the vacuum valve.

Figure 5:
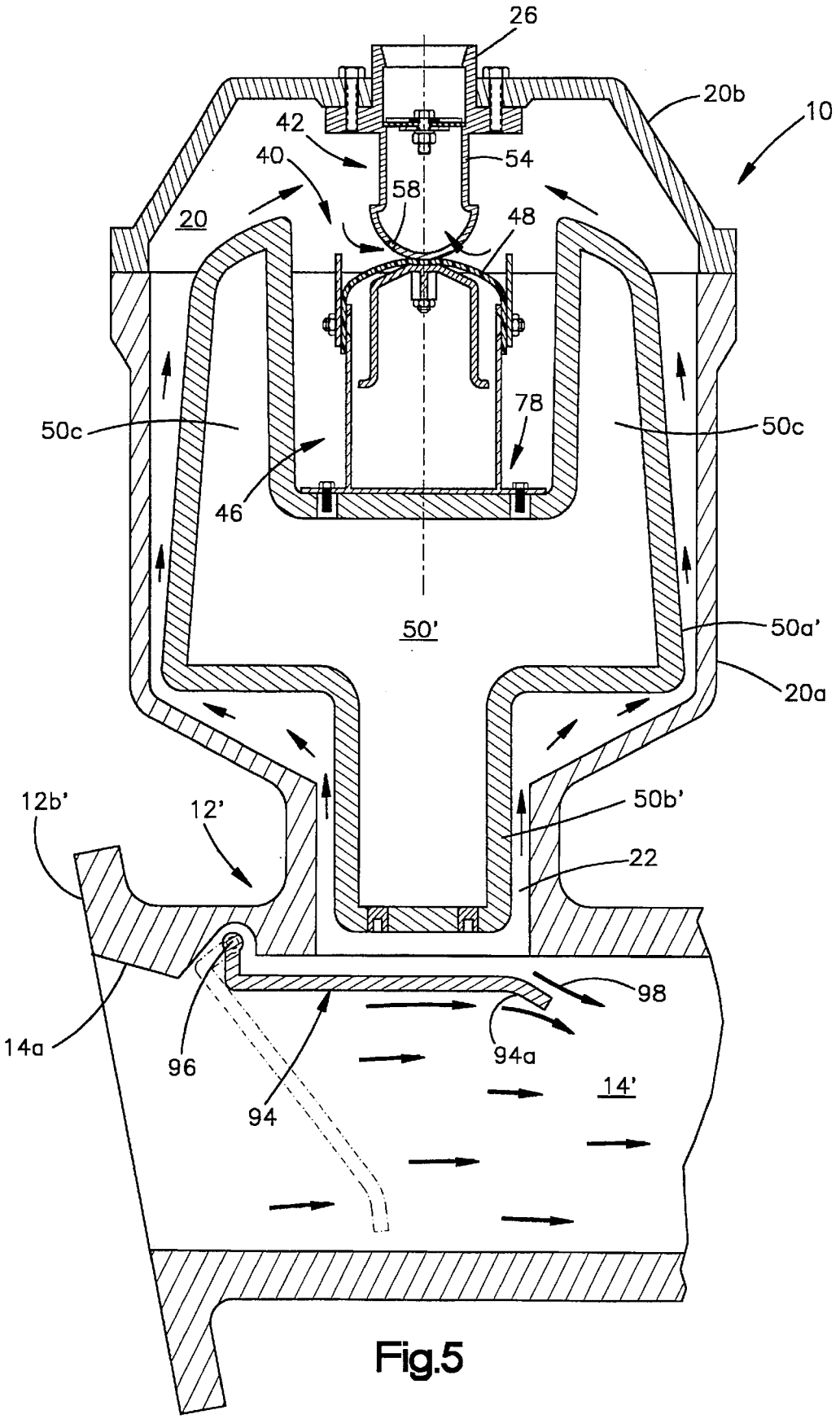
FIG. 5 is a sectional view showing another embodiment of the priming assembly.

FIG. 5 illustrates another embodiment of the invention, as well as an additional feature that can be made part of either the FIG. 1 or FIG. 4 embodiments. Components in FIG. 5 which are identical to components illustrated in FIG. 1 will be given the same reference character, whereas components that provide the same function but have a slightly different configuration will be given the same reference character followed by an apostrophe.

FIG. 5 includes a vacuum Valve assembly 40 that is similar, if not identical, to the vacuum valve assembly shown in FIG. 1. It includes fixed and movable portions 42, 46. A closure member 48, which is connected to a bracket 78, is wrappingly engageable with a circular surface defined by a valve body 54 and thereby controls communication of the vacuum chamber 20 with a vacuum source connected to the fitting 26.

The movable portion 46 in the FIG. 5 embodiment is operated by a float 50' which has a different configuration from the float shown in FIG. 1. In particular, the float 50' includes an enlarged portion 50*a*', a tamper portion 50*b*' and at least one, but preferably two upstanding extension portions 50*c*. The extensions 50*c* may have several functions. Firstly, the extensions take up additional volume in the chamber 20. It has been found that after the closure member 48 closes off the ports 58*a*, thereby isolating the chamber 20 from the vacuum source, the residual vacuum in the chamber will cause an additional rise in the liquid level. It is believed that the extent to which the residual vacuum causes an increase in liquid level rise is a function of the free volume within the chamber. By increasing the size of the float 50' the free volume of the vacuum chamber 20 is reduced, thereby reducing the rise of liquid within the chamber when the closure member isolates the chamber from the vacuum source.

The extensions 50*c* also provide an additional feature of the invention in that they also act as shields to inhibit the splashing of liquid and possibly liquid carried solids onto the closure member 48, which could result in the ingestion of liquid and/or solids into the vacuum system. As stated above, in the preferred embodiment, two extensions 50*c* are employed and, hence, both sides of the closure member 48 are shielded. However, the invention also contemplates a single extension 50*c* which may be necessary in some applications in order to arrive at a required buoyancy for the float 50.

The embodiment of FIG. 5 also includes a shield for reducing the possibility of having solids drawn into the vacuum chamber. In the preferred embodiment, the shield comprises a moveable flapper 94 which is mounted in an inlet passage 14'. The flapper 94 is hinged by a pin 96 and includes a "kicker" portion 94*a*. When the pump is pumping liquids, the liquid traveling along the passage 14' maintains the flapper in the upper position shown in solid in FIG. 5. When the pump is at rest or during a priming cycle when air is being drawn through the passage, the flapper 94 will be somewhere between the fully opened position shown in solid and a fully closed position shown in phantom, depending on the extent of liquid flowing through the passage 14'.

The "kicker" portion 94*a* provides several advantages. Firstly, it is believed that it increases the rate at which the flapper responds to liquid entering the passage 14' and, in other words, the kicker 94*a* will cause the flapper to move to its upper position at which it is blocking direct access to the passage 22, in a short amount of time. In addition, the liquid flowing along the passage 14' with the flapper in its upper position, has a venturi-like effect (as indicated by arrow 98) on the liquid trying to enter the passage 22 and, hence, maintains a lower water level in the priming chamber 20.

The invention also contemplates a fixed shield which may, for example comprise, fixed element shaped and located in the position defined by the open position of the moveable flapper 94.

According to an additional feature of this embodiment, the entry to the passage 14' includes a deflector ramp 14*a*' Which inhibits stringy pumpage from attaching to the flapper. In the upper position, the flapper blocks direct communication between the passage 14' and the transfer passage 22 and, thus, inhibits the flow of solids carried by the pumpage into the passage 22.

The vacuum source 28, indicated schematically in FIG. 3, may take several forms and the present invention is not limited to any particular type of vacuum source. The invention, however, is especially useful in those systems that are sensitive to "carry over", such as a vacuum pump. If not controlled, carry over can easily damage the pump.

The invention, however, is equally applicable to systems utilizing an air compressor/eductor system as a source of vacuum for the priming chamber 20. Moreover, in systems that use an air compressor/eductor arrangement to produce a vacuum, an additional feature of the invention is provided.

Figure 6:
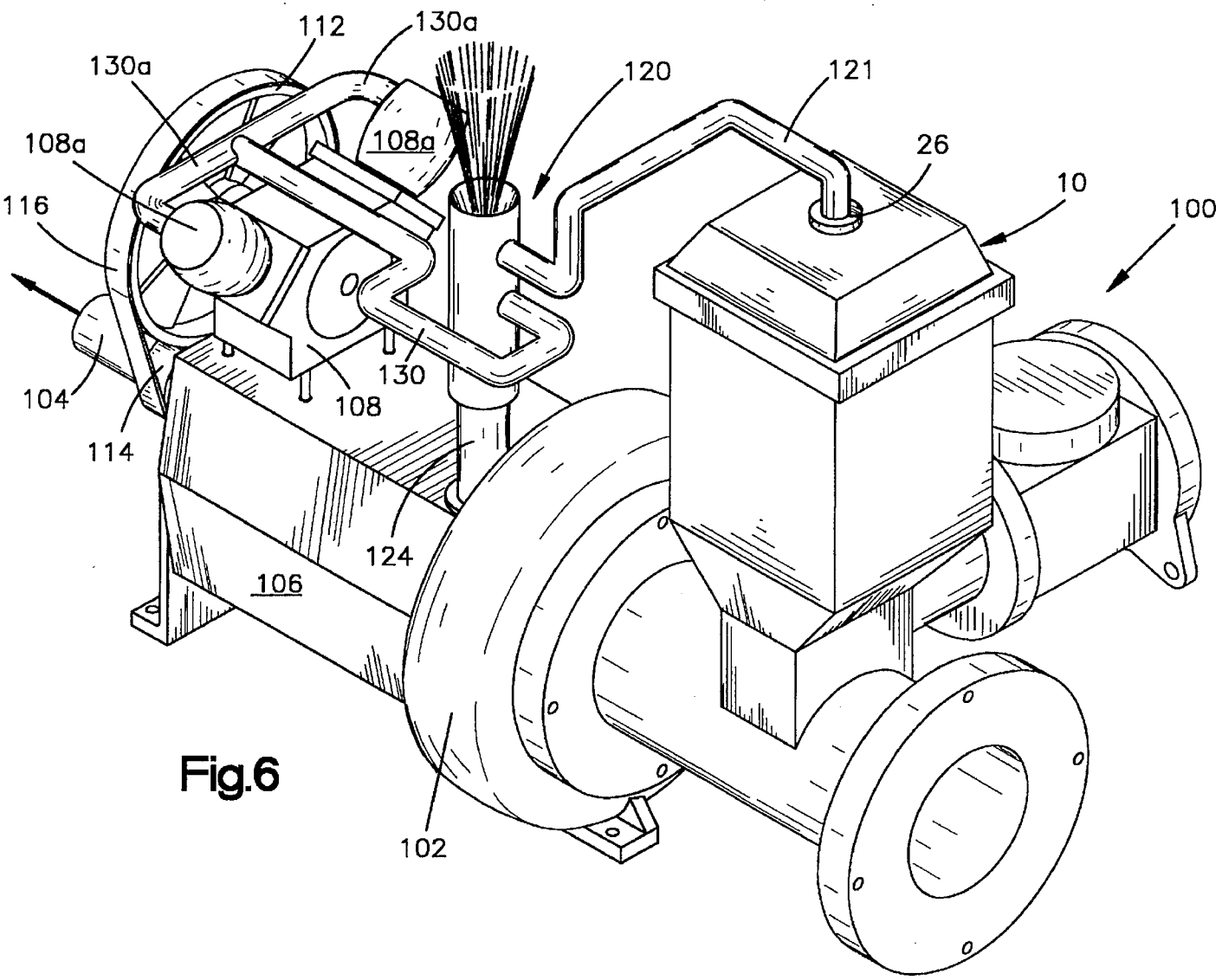
FIG. 6 is a perspective view of an eductor-type priming system having a cooling arrangement constructed in accordance with the preferred embodiment of the invention.
Figure 8:
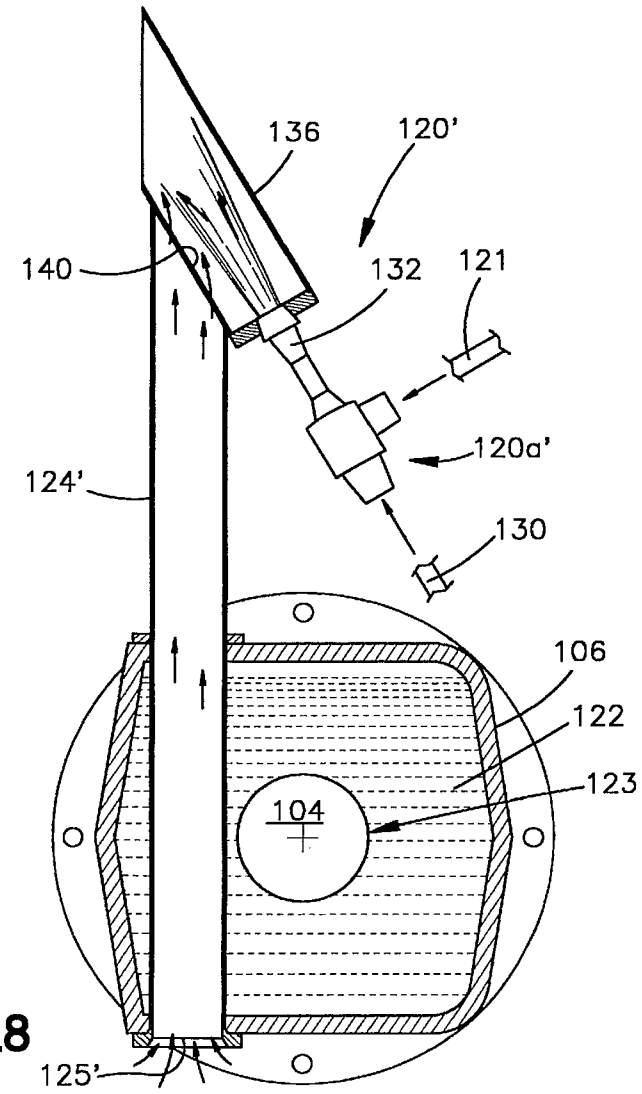
FIG. 8 illustrates an alternate embodiment of the cooling arrangement.
Figure 7:
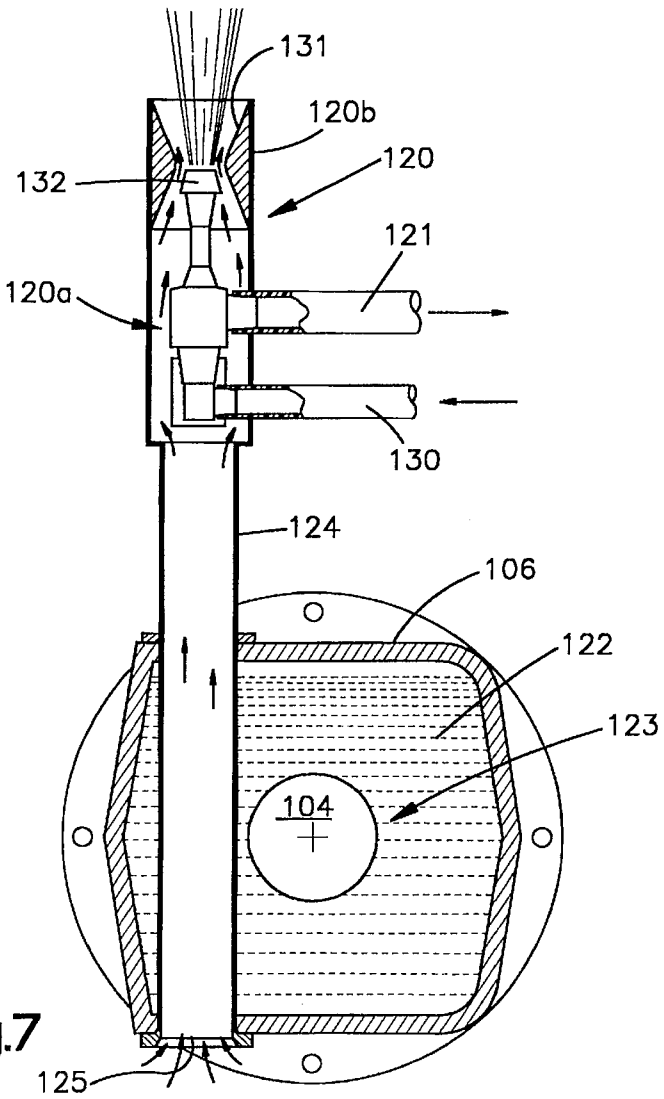
FIG. 7 is a sectional view showing details of the cooling arrangement shown in FIG. 6.

Referring to FIGS. 6–8, a pump assembly 100 is illustrated that includes the priming assembly 10 attached to the inlet of a centrifugal pump impeller chamber 102. A conventional impeller (not shown) is attached to and is driven by a drive shaft, a driven end of which is indicated by the reference character 104. The drive shaft 104 is rotatably supported within a bearing housing 106 which, as is known, houses one or more bearings (not shown). The end of the drive shaft 104 is coupled to a power source (not shown), such as an electric motor or internal combustion engine.

An air compressor 108 is mounted to the bearing housing 106 and includes a driven pulley 112 which is suitably driven by the drive shaft 104, via a drive pulley 114 and a drive belt 116. It should be understood that other drive mechanisms, such as chains and sprockets may be used to drive the compressor 108. The compressor provides a source of high pressure air that is communicated to an eductor assembly 120 (shown in FIG. 7), which using a venturi principal, generates a source of vacuum for the priming chamber the eductor assembly is connected to the vacuum chamber fitting 26 by a vacuum line 121.

It should be noted that for purposes of the invention, the source of air pressure for the eductor may be obtained from a remote air compressor that is independently driven by a power source separate and apart from the drive motor connected to drive shaft 104.

Referring also to FIG. 7, a seal chamber indicated generally by the reference character 122 is located between the impeller housing 102 and the bearing housing 106. The seal chamber encloses a conventional seal (the location of which is generally indicated by the reference character 123), a rotating portion of which is carried by the drive shaft 104 and a non-rotating portion of which is mounted at the rear of the impeller chamber. The seal as is known, is operative to inhibit the leakage of pumpage out of the impeller housing 102 and into the bearing housing 106 and to inhibit leakage to the outside environment.

For most applications, a conventional face-type seal is employed. Because the pump may be run "dry" for long periods of time, the seal chamber is liquid filled to cool and/or lubricate the seal. According to the invention, a provision is made for providing cooling of the oil contained within the chamber 122. To provide this feature, a conduit 124 extends through the seal chamber 122. The wall of the conduit portion that extends through the seal chamber defines a heat exchange surface. An inlet 125 is defined at one end of the conduit 124 through which cooling air is drawn. The opposite end of the conduit mounts the eductor assembly 120.

According to the invention, the eductor assembly 120 comprises staged primary and secondary eductor portions indicated generally by the reference characters 120*a*, 120*b*. The primary portion 120*a* serves as a source of vacuum for the priming chamber 20. In particular, the primary eductor receives nigh pressure air from the compressor 108 by way of conduit 130. In the illustrated embodiment, the conduit 130 receives high pressure from individual air compressor cylinders 108*a* by means of branch conduits 130*a*.

The eductor portion 120*a* may be of conventional construction and may in fact be a purchased item. For example, a model GL1 jet pump available from Penberthy Inc. of Prophetstown, Ill. may serve as the primary eductor 120*a*. The high pressure air leaving the primary eductor 120*a* is communicated to the secondary eductor 120*b*. In the embodiment illustrated in FIG. 5, the secondary eductor 120*b* is formed by a venturi passage 131 and a nozzle 132 positioned within the venturi passage 131. As the air is discharged by the nozzle 132, a region of lower pressure is created in the throat of the venturi passage 131 and causes air to be drawn into the conduit inlet 125 and cause to flow upwardly thorough the conduit 124, past the nozzle 132. As the air flows through the conduit 124, it accepts heat transferred from the oil in the seal chamber 122 to the wall of the conduit 122 thus effecting cooling of the seal chamber oil.

FIG. 6 illustrates another embodiment of this feature of the invention. In this embodiment, a conduit 124' extends through the seal chamber 122 and defines an air inlet 125'. In this arrangement, a nozzle 132 of an eductor assembly 120' discharges the air leaving the primary eductor 120*a'* into a cross conduit 136. The cross conduit 136 is arranged at a predetermined angle with respect to the cooling conduit 124'. The air flowing past an upper opening 140 of the conduit 124' creates a chimney effect causing air to be drawn into the inlet 125', travel upwardly through the conduit 124' and into the cross conduit 136. The flow of air through the vertical conduit shown in FIG. 6 effects cooling of the seal chamber oil in the seal chamber 122.

The disclosed cooling mechanism provides a cost effective and efficient way for reducing or removing heat from the pump seal assembly. It utilizes what would otherwise be wasted energy to provide the flow of cooling air through the cooling conduit 124. In addition, the cooling conduit serves as a support and mounting point for the eductor assembly, thus providing an integrated and compact unit for providing, both the priming and cooling functions. It should be understood that the cooling effect provided by the disclosed apparatus may be enhanced by adding additional heat exchange surfaces, i.e., fins, etc. to the inside or outside of the conduit 124 in FIG. 7 or the conduit 124' in FIG. 8.

Although the invention has been described with a certain degree of particularity, it should be understood that those skilled in the art can make various changes to it without departing from the spirit or scope of the invention as hereinafter claimed.

I claim:

1. A vacuum assisted priming system for a fluid pump, comprising:

a) structure defining a Vacuum chamber connected to a source of vacuum;

b) a valve body located within said chamber and including at least one port for communicating said source of vacuum with said chamber;

c) a closure element engageable with said valve body for blocking said port whereby the communication of said vacuum source with said chamber is terminated;

d) a float operatively connected to said closure element for moving said closure element into blocking engagement with said port in said valve body when said float rises above a predetermined level; and, e) a lost motion connection between said float and said closure element which enables said float to rise to a level above said predetermined level, while said closure element maintains its blocking engagement with said port.

2. The system of claim 1, wherein said closure element is engageable with said valve body in an overlying relationship.

3. The apparatus of claim 1, wherein said float comprises an enlarged portion which acts as a defuser for liquid entering said vacuum chamber.

4. The apparatus of claim 3, wherein said float also includes a tamper portion, at least a portion of which is received in a transfer passage that communicates said vacuum chamber with an inlet to said fluid pump.

5. The apparatus of claim 4, wherein said tamper portion is operative to dislodge matter drawn into said transfer passage.

6. The system of claim 4, further comprising a shield member operative to overlie said transfer passage while still permitting fluid communication between said pump inlet and said transfer passage.

7. The system of claim 6, wherein said shield includes an offset portion defining an expanding passage that communicates said transfer passage with said pump inlet, said expanding passage creating a venturi-like effect as pumpage flows to said pump inlet, whereby a liquid level in said vacuum chamber is reduced.

8. The apparatus of claim 6, wherein said shield member is mounted for movement between closed and open positions within a pump inlet passage.

9. The apparatus of claim 6, wherein said shield member is mounted in a fixed position with respect to said transfer passage.

10. The apparatus of claim 3, wherein said float is substantially square in cross-section.

11. The system of claim 3, wherein said float further includes at least one extension portion which also acts as a shield to inhibit liquid from being splashed onto said closure element.

12. The apparatus of claim 1, wherein said valve body is semi-circular in shape and defines a plurality of ports, all of which are blocked by said closure element when said float rises to said predetermined level.

13. The apparatus of claim 12, wherein said closure element comprises a flexible sheet having a portion attached to said valve body and at least one other portion attached to said float and said lost motion connection is provided by a section of said flexible sheet.

14. The apparatus of claim 13, wherein a central portion of said flexible sheet is attached to, substantially aligned with a centerline of, said valve body and said closure element includes two sealing sections extending from said central portion and said sealing sections having peripheral edges attached to said float.

15. The apparatus of claim 14, wherein said central portion of said sealing element is attached to said valve body by a clamp plate having a pair of downwardly depending flanges, such that said clamp plate is substantially U-shaped in cross-section.

16. The apparatus of claim 1, wherein the float has relatively low buoyancy.

17. The apparatus of claim 1, wherein said float carries a bracket to which a portion of said closure element is attached and said bracket is configured to provide a predetermined buoyancy to said float.

18. The apparatus of claim 17, wherein said bracket comprises a base from which two parallel upstanding legs extend to which sealing sections of said closure element are attached.

19. The apparatus of claim 18, wherein said bracket legs also mount guides associated with each sealing section of said closure element which are operative to control movement of said sealing sections of said closure element as said float moves relative to said valve body.

20. The apparatus of claim 1, wherein said closure element includes two sealing sections, each one of these sections being attached to a connecting member carried by said float.

21. The apparatus of claim 20, wherein said valve body defines a line of ports on either side of a centerline, one line of ports being engageable by one sealing section of said closure element, the other line of said ports being engageable by another sealing section of said closure element.

22. The apparatus of claim 1, wherein said valve body includes a check valve which allows fluid flow from said chamber to said source of vacuum, but prevents reverse flow.

23. The apparatus of claim 1, wherein said system comprises a separate component attachable to an inlet of a centrifugal pump.

24. The system of claim 1, wherein said closure element and valve body are disposed at an angle with respect to the horizontal.

25. The system of claim 24, wherein the angle is substantially 25°.

26. The system of claim 1, wherein said float is configured to occupy a substantial volume of said vacuum chamber.

27. A vacuum assisted priming system for a fluid pump, comprising:

a) structure defining an enclosed vacuum chamber connectable to a source of vacuum;

b) a valve body located within said chamber and including at least one port for communicating said source of vacuum with the inside of said chamber;

c) a closure element engageable in an overlying relationship with said valve body whereby the communication of said vacuum source with said chamber is terminated, said closure element carried by a float located within said vacuum chamber, said closure element engaging said valve body in a wrapping, overlying relationship when said float rises above a predetermined level in said chamber;

d) a lost motion connection between said float and said valve body which enables said float to rise to a level above said predetermined level, while said closure element maintains its overlying relationship with respect to said port.

28. A vacuum assisted pump priming system, comprising:

a) structure defining a vacuum chamber in fluid communication with a suction side of a pump;

b) a valve assembly for controlling the communication of a source of vacuum with said chamber, said valve assembly comprising:

i) a valve body fixed with respect to said chamber and connected to said vacuum source, said body defining a plurality of ports through which said vacuum source communicates with said chamber;

ii) a float movable towards and away from said valve body and carrying a closure member defined by a flexible sheet, said closure member engageable with said valve body and overlying said ports when said float rises to a predetermined level;

iii) a lost motion connection between said float and said valve body which permits said float to rise an additional distance above said predetermined level while said closure member maintains its overlying engagement with said valve body.

29. A vacuum assisted priming system for a fluid pump, comprising:

a) structure defining a vacuum chamber;

b) a valve body located within said chamber and including at least one port for communicating a source of vacuum with said chamber;

c) a closure element engageable with said valve body for blocking said port whereby the communication of said vacuum source with said chamber is terminated;

d) a float operatively connected to one of said closure element and said valve body, and operative to effect relative movement between said closure element and said valve body in response to changes in liquid level in said chamber and further operative to effect movement of said closure element into blocking engagement with said port in said valve body when said float rises above a predetermined level; and, e) a lost motion connection associated with said closure element which enables said float to rise to a level above said predetermined level, while said closure element maintains its blocking engagement with said port.

30. The vacuum assisted priming system of claim 29, wherein said float is operatively connected to said closure element.

31. The priming system of claim 29, wherein said lost motion connection operatively connects said closure element with said float.

32. A vacuum assisted priming system for a fluid pump, comprising:

a) structure defining an enclosed vacuum chamber;

b) a valve body located within said chamber and including at least one port for communicating a source of vacuum with the inside of said chamber;

c) a closure element engageable in an overlying relationship with said valve body whereby the communication of said vacuum source with said chamber is terminated, said closure element engageable with said valve body in a wrapping, overlying relationship when a liquid level in said chamber rises above a predetermined level;

d) a lost motion connection within said chamber which enables said liquid level to rise to a level above said predetermined level, while said closure element maintains its overlying relationship with respect to said port.

33. The priming system of claim 32, further comprising a float operatively connected to one of said valve body and said closure element.

34. The priming system of claim 33, wherein said float is operatively coupled to said closure element.

35. The priming system of claim 33, wherein said lost motion connection operatively couples said closure element with said float.

* * * * *